US010277013B2

(12) United States Patent
Zheng et al.

(10) Patent No.: US 10,277,013 B2
(45) Date of Patent: Apr. 30, 2019

(54) HIGH-POWER BREAKDOWN SPARK PLUGS AND RELATED METHODS

(71) Applicant: Ming Zheng, Windsor (CA)

(72) Inventors: Ming Zheng, Windsor (CA); Shui Yu, Windsor (CA); Mengzhu Liu, Guanhaiwei (CN); Liguang Li, Shanghai (CN)

(73) Assignee: Ming Zheng, Windsor (CA)

( * ) Notice: Subject to any disclaimer, the term of this patent is extended or adjusted under 35 U.S.C. 154(b) by 177 days.

(21) Appl. No.: 15/162,473

(22) Filed: May 23, 2016

(65) Prior Publication Data

US 2017/0256919 A1 Sep. 7, 2017

Related U.S. Application Data

(60) Provisional application No. 62/174,448, filed on Jun. 11, 2015.

(51) Int. Cl.

| | |
|---|---|
| ***H01T 13/40*** | (2006.01) |
| ***H01T 21/02*** | (2006.01) |
| ***H01T 13/41*** | (2006.01) |

(52) U.S. Cl.

CPC ..... *H01T 13/40* (2013.01); *H01T 13/41* (2013.01); *H01T 21/02* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,329,743 | B1 | 12/2001 | Camilli | |
| 8,672,721 | B2 | 3/2014 | Camilli | |
| 2008/0018216 | A1* | 1/2008 | Camilli | F02P 3/08 313/141 |
| 2012/0142243 | A1* | 6/2012 | Camilli | F02P 3/08 445/7 |

* cited by examiner

*Primary Examiner* — Nimeshkumar Patel
*Assistant Examiner* — Jacob R Stern
(74) *Attorney, Agent, or Firm* — IPTechLaw

(57) ABSTRACT

A spark plug includes an insulator body and a central electrode having a spark-end and a terminal-end. The central electrode is disposed within the insulator body, with the spark-end and the terminal-end protruding from the insulator body at opposite ends thereof. A metal electrode surrounds the insulator body and extends to form a gap with the central electrode at the spark-end. A capacitor with metalized inner and outer surfaces is provided, with the metalized inner surface being connected to the central electrode and the metalized outer surface being connected to the metal electrode. A first resistive component is embedded within the central electrode between the capacitor and the terminal-end, and a second resistive component embedded within the central electrode between the capacitor and the spark-end.

13 Claims, 4 Drawing Sheets

HIGH-POWER BREAKDOWN SPARK PLUGS AND RELATED METHODS

CROSS REFERENCE TO RELATED APPLICATIONS

This document claims the benefit of the filing date of U.S. Provisional Patent Application 62/174,448, entitled "High-Power Breakdown Spark Plug" to Ming Zheng et al. which was filed on Jun. 11, 2015, the disclosure of which is hereby incorporated entirely herein by reference.

BACKGROUND

1. Technical Field

Aspects of this document relate generally to the ignition systems. More particular implementations relate to high-power breakdown spark plugs for internal combustion engines.

2. Background

To ensure the ignition of lean/diluted mixtures in modern advanced internal combustion engines, high-energy spark ignition systems and novel spark plugs are used to initiate and promote the ignition process. A spark discharge process can be divided into a breakdown period and a continuous discharge period. The breakdown period is identified as capacitive discharge, characterized by short duration and high peak current. On the other hand, the subsequent continuous discharge period is a resistive discharge with relatively long duration and low current.

A step-up transformer of the ignition coil boosts the voltage to break down the spark gap; however, the energy discharged during breakdown comes from the near-gap capacitors, which are charged during a pre-breakdown voltage build-up process. The capacitive discharge during breakdown is highly dynamic, lasting only on a time-scale that is measured in the nanoseconds range. The characteristics of the step-up transformer, such as the turn ratio and the impedance of the windings, affect the breakdown process insignificantly but determine the characteristics of the continuous discharge period.

Although the breakdown process delivers only a very low portion of the overall ignition energy, due to its short duration, the features of high voltage and high current are favorable to ignite lean and diluted mixtures. Thus, enhancement of the capacitive discharge energy during the breakdown process can significantly promote the ignition process. To increase the capacitive discharge energy an increase of the near-gap capacitance is useful. A spark plug forms a virtual concentric cylindrical capacitor, with the outer surface of the center electrode and the inner surface of the metal shell as the conductors, and the insulation ceramic as the dielectric media. The spark plug insulator is normally made from alumina (Al2O3), which possesses excellent mechanical strength and thermal conductivity, and which has been employed commonly for internal combustion engines. Due to the relatively low dielectric constant of alumina (~10) and the poor metal-ceramic surface contact of a conventional spark plug structure, the capacitance of a conventional spark plug ranges from about 10-20 pF, providing up to about 2-3 mJ of breakdown energy.

SUMMARY

Implementations high-power breakdown spark plugs may include: an insulator body; a central electrode having a spark-end and a terminal-end, the central electrode disposed within the insulator body with the spark-end and the terminal-end protruding from the insulator body at opposite ends thereof; a metal electrode surrounding the insulator body and extending to form a gap with the central electrode proximate the spark-end; a capacitor with metalized inner and outer surfaces, the metalized inner surface connected to the central electrode and the metalized outer surface connected to the metal electrode; a first resistive component embedded within the central electrode between the capacitor and the terminal-end for suppressing electromagnetic interference, and; a second resistive component embedded within the central electrode between the capacitor and the spark-end.

Implementations of high-power breakdown spark plugs may include one, all, or any of the following:

The capacitor may include an annular capacitor having a central through passage, the insulator body may be received within the central through passage, and the high-power breakdown spark plug may further include a conductive element extending between the metalized inner surface of the capacitor and the central electrode via a channel defined through the insulator body.

The insulator body may include a unitary structure having a sealing surface and a positioning shoulder configured to engage the metal electrode and form a gas-tight seal.

The insulator body may include a spark-end portion having a sealing surface and a separate terminal-end portion having a positioning shoulder, the sealing surface and positioning shoulder configured to engage the metal electrode and form a gas-tight seal.

The capacitor may include a ceramic material that is sandwiched between the spark-end portion and the terminal-end portion of the insulator body.

The ceramic material may be affixed to the insulator body between the spark-end portion and the terminal-end portion of the insulator body, the ceramic material having a substantially higher dielectric constant than the insulator material.

The capacitor may be an annular capacitor having a central through passage, and the central electrode may be received within the central through passage.

The insulator body may include a plurality of circumferentially spaced capacitor channels and the capacitor may include a plurality of elements disposed one each within the plurality of capacitor channels.

The insulator body may include a unitary structure having a sealing surface and a positioning shoulder for engaging the metal electrode and for forming a gas-tight seal.

The insulator body may include a spark-end portion and a separate terminal-end portion; the metal electrode may include a spark-end portion and a separate terminal end portion; the capacitor may be disposed between the spark-end portion and the terminal end portion of the insulator body; a first end of the spark-end portion of the metal electrode may extend to form the gap and a second end of the spark-end portion of the metal electrode may be crimped to engage a shoulder of the spark-end portion of the insulator body for securing the spark-end portion of the insulator body within the spark-end portion of the metal electrode, and; a first end of the terminal-end portion of the metal electrode may be fixedly secured to the second end of the spark-end portion of the metal electrode by a weld seam, and a second end of the terminal end portion of the metal electrode may be crimped to engage a shoulder of the terminal-end portion of the insulator body for securing the terminal-end portion of the insulator body within the terminal end portion of the metal electrode.

A first insulating gasket may be disposed between the spark-end portion of the insulator body and a first end of the capacitor, and a second insulating gasket may be disposed between the terminal end portion of the insulating body and a second end of the capacitor.

Implementations of high-power breakdown spark plugs may include: an insulator having an opening extending there through for accommodating a central electrode, the insulator forming an annular ring about the opening, the insulator including: a first dielectric material adjacent a first end of the insulator; a third dielectric material adjacent a second opposing end of the insulator, and; a space between the first and third dielectric materials receiving a second insulating material having a higher dielectric constant than the first and third dielectric materials, the second insulating material disposed between the first dielectric material and the third dielectric material.

Implementations of high-power breakdown spark plugs may include one, all, or any of the following:

The space may form a gap between the first dielectric material and the third dielectric material, the gap receiving the second dielectric material having a higher dielectric constant and forming part of a capacitor.

The gap may include openings for accommodating capacitors disposed circumferentially between the first and third dielectric materials.

The gap may be maintained by spacers between the first and third dielectric materials, the spacers formed of at least one of the first and third dielectric materials and for maintaining a gap spacing while providing openings for the circumferentially disposed capacitors.

The gap may be formed by sandwiching a capacitor disposed circumferentially about the opening between the first dielectric material and the third dielectric material to form a single insulator component.

Implementations of methods of manufacturing a high-power breakdown spark plug may include: disposing a first insulator body within a first metal shell-part; crimping an end of the first metal shell-part to engage a shoulder of the first insulator body, the first insulator body having a central electrode bonded within a central opening thereof; assembling capacitor components within a second metal shell-part; welding the first and second metal shell-parts together, such that the capacitor components are aligned with and adjacent to the first insulator body and the central electrode extends through a central opening of the capacitor components; assembling a second insulator body within the second metal shell-part, such that the capacitor components are aligned with and sandwiched between the second insulator body and the first insulator body, and such that the central electrode extends through a central opening of the second insulator body; and crimping an end of the second metal shell-part to engage a shoulder of the second insulator body.

Implementations of methods of manufacturing a high-power breakdown spark plug may include one, all, or any of the following:

Disposing first insulating gaskets between the first insulator body and the capacitor components prior to welding together the first and second metal shell-parts.

Disposing second insulating gaskets between the second insulator body and the capacitor components prior to crimping the end of the second metal shell-part.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

Figure 1:
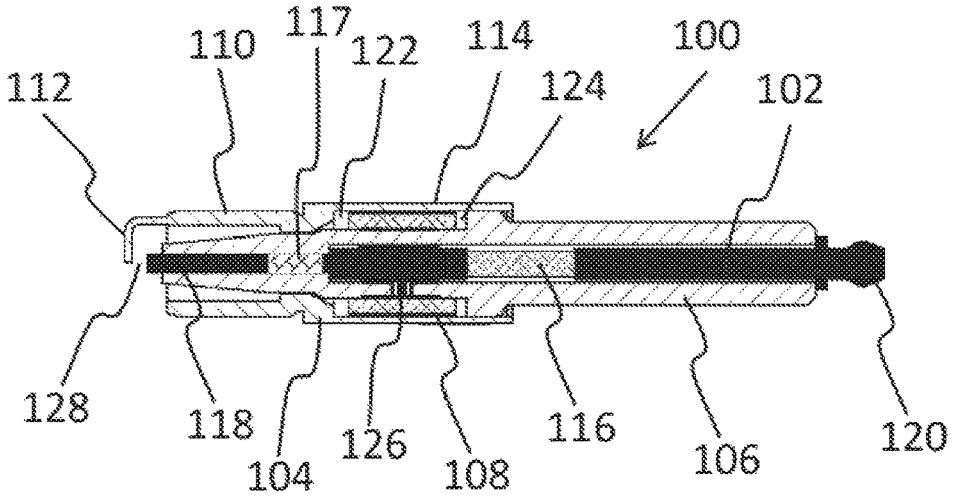
FIG. 1 is a longitudinal cross-sectional view of an implementation of a spark plug.

This disclosure, its aspects and implementations, are not limited to the specific components, assembly procedures or method elements disclosed herein. Many additional components, assembly procedures and/or method elements known in the art consistent with the intended high-power breakdown spark plugs and related methods will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such high-power breakdown spark plugs and related methods, and implementing components and methods, consistent with the intended operation and methods.

In implementations a spark plug includes high-dielectric ceramic components embedded into the alumina insulator. This arrangement increases the capacitance of the spark plug without sacrificing mechanical strength and thermal conductivity. In order to ensure surface contact between the dielectric ceramic and the metal conductors of the spark plug, the ceramic surfaces are metallized. The capacitance of such a spark plug can exceed 100 pF, and the spark plug is capable of storing over 10 mJ of energy prior to breakdown.

In implementations a spark plug includes: an insulator body; a central electrode having a spark-end and a terminal-end, the central electrode disposed within the insulator body with the spark-end and the terminal-end protruding from the insulator body at opposite ends thereof; a metal electrode surrounding the insulator body and extending to form a gap with the central electrode proximate the spark-end; a capacitor with metalized inner and outer surfaces, the metalized inner surface connected to the central electrode and the metalized outer surface connected to the metal electrode; a first resistive component embedded within the central electrode between the capacitor and the terminal-end for suppressing electromagnetic interference; and a second resistive component embedded within the central electrode between the capacitor and the spark-end.

In implementations a spark plug includes: an insulator having an opening extending there through for accommodating a central electrode, the insulator forming an annular ring about the opening, the insulator comprising: first dielectric material adjacent a first end of the insulator, third dielectric material adjacent a second opposing end of the insulator, and a space between the first and third dielectric materials for accommodating a second insulating material having a higher dielectric constant than the first and third dielectric materials and disposed between the first dielectric material and the third dielectric material.

In implementations a spark plug includes annular sintered dielectric material and at least a metal layer deposited on inner and outer surfaces thereof for forming an annular capacitor.

In implementations, a method of manufacture of a spark plug includes: assembling a first insulator body within a first metal shell-part; crimping an end of the first metal shell-part to engage a shoulder of the first insulator body, the first insulator body having a central electrode bonded within a central opening thereof; assembling capacitor components within a second metal shell-part; welding the first and second metal shell-parts together, such that the capacitor components are aligned with and adjacent to the first insulator body and the central electrode extends through a central opening of the capacitor components; assembling a second insulator body within the second metal shell-part, such that the capacitor components are aligned with and sandwiched between the second insulator body and the first insulator body, and such that the central electrode extends through a central opening of the second insulator body; and crimping an end of the second metal shell-part to engage a shoulder of the second insulator body.

The following description is presented to enable a person skilled in the art to make and use implementations disclosed herein, and is provided in the context of a particular application and its requirements. Various modifications to the disclosed embodiments will be readily apparent to those skilled in the art, and the general principles defined herein may be applied to other embodiments and applications without departing from the scope of the principles disclosed herein.

FIG. 1 is a longitudinal cross-sectional view showing an assembled spark plug according to an embodiment. The spark plug 100 includes a central electrode 102, a metallic shell 104, an insulator 106 that is made of aluminum oxide, and capacitor components shown generally at 108. One end 110 of the metallic shell 104 has a standard external mounting thread (not shown), and is welded with the ground electrode 112. The other end 114 of the metallic shell 104 has a hexagon shape (not shown) to facilitate the application of a mounting torque.

The central electrode 102 is embedded in the insulator body 106, and is fixed using high-temperature adhesive. A first resistive component 116 is built into the central electrode 102 to suppress high frequency noise during the discharging process. A second resistive component 117 is embedded between the capacitor components 108 and the spark-end of central electrode 102, in order to reduce the peak spark current and thereby provide a longer electrode life. The central electrode 102 is divided into four parts: spark-end 118, terminal end 120 first resistive component 116 and second resistive component 117. The tip of the central electrode 102 at the spark end 118 can be welded with precious metal, for example, iridium, chromium, etc., to increase the service life of the electrode 102.

Figures 2A, 2B:
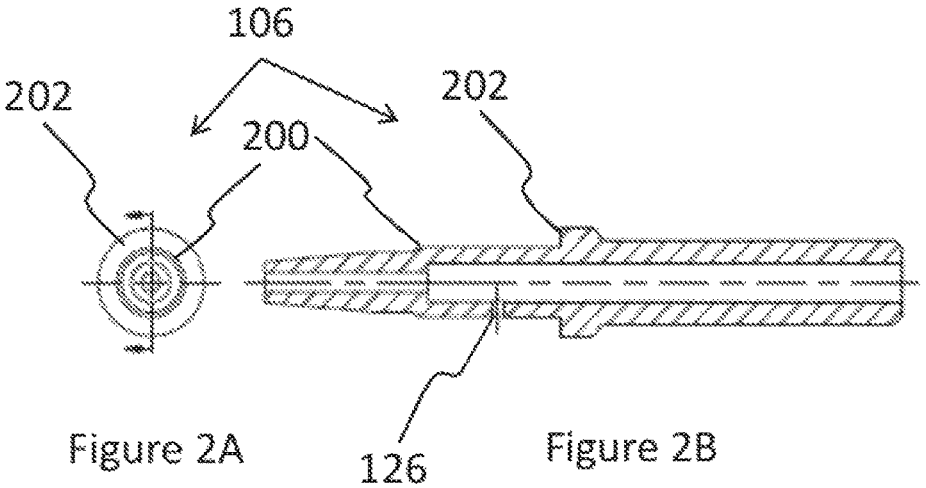
FIG. 2A is an end view of an insulator of the spark plug of FIG. 1.
FIG. 2B is a longitudinal cross-sectional view of the insulator of FIG. 2.

Referring now to FIGS. 2A and 2B, the insulator body 106 has two shoulders 200 and 202. The left shoulder 200 (also referred to as the first shoulder) is a chamfer surface for establishing a seal. Typically, a gasket such as a copper washer is compressed between the shoulder 202 and an opposing inner surface of the metallic shell 104 for sealing purpose. The right shoulder 202 (also referred to as the second shoulder) is used to position the capacitor components 108, and is riveted with the metallic shell 104 for fastening and sealing purposes.

Figures 3A, 3B:
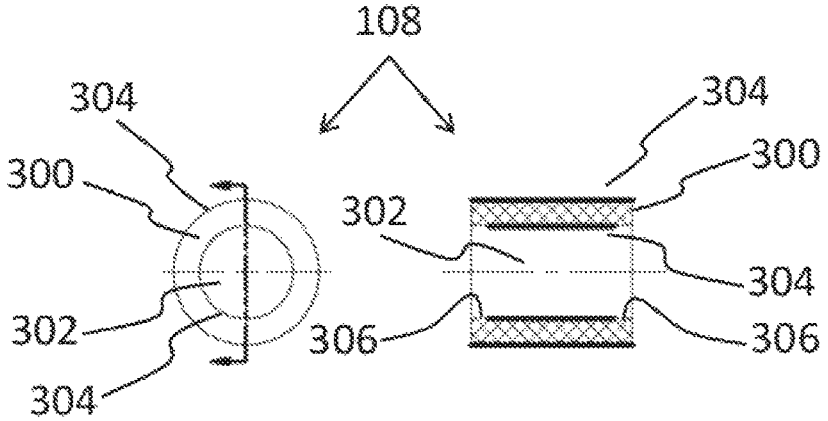
FIG. 3A is an end view of an annular capacitor of the spark plug of FIG. 1.
FIG. 3B is a longitudinal cross-sectional view of the annular capacitor of FIG. 3A.

Referring now to FIGS. 3A and 3B, the capacitor components 108 form a substantially concentric cylinder structure. A sintered ceramic material 300, with high dielectric constant, forms an annular shape with a through-passage 302 for receiving the insulator body 106. Some specific and non-limiting examples of suitable sintered ceramic materials include: strontium titanate, barium strontium titanate, barium titanate, copper calcium titanate, etc. A silver oxide coating forms a silver film 304 during the sintering process under temperature of 800 C-900 C, and both inner and outer surfaces of the capacitor can be metalized in this way. The opposite ends 306 of the capacitor inner surface are not metalized, as shown in FIG. 3B, in order to increase the distance between the metalized inner surface and the ground electrode, and to prevent the occurrence of a breakdown event along the capacitor surface. Referring again to FIG. 1, when the spark plug 100 is in an assembled condition the resulting gap 122 between one end of the capacitor 108 and the insulator body 106, as well as the resulting gap 124 between the other end of the capacitor 108 and the metallic shell 104, is filled with high-temperature insulating material, for example, high temperature epoxy resin, etc. In addition to electrically insulating the capacitor, the high-temperature insulating material also enhances the gas sealing effect. A small hole 126 is formed through the insulator body 106, and is filled with conductive metal in order to connect the inner surface of the capacitor component 108 with the central electrode 102. Optionally, in order to enhance the connection reliability between the central electrode 102 and the capacitor component 108, the surfaces of the hole 126, as well as the inner and outer surfaces of the insulator body 106 near the hole 126, are all metalized.

In the specific example that is shown in FIG. 1, resistive component 116 is placed "upstream" relative to the capacitor 108, and therefore no current goes through the resistive component 116 when the capacitor 108 is discharging to the spark gap 128 during the breakdown process.

When a not illustrated ignition coil provides high voltage to the spark plug, the capacitor 108 is charged first, and starts to discharge to the spark gap 128 after the breakdown process, thereby enhancing the breakdown energy. The energy of the ignition coil is released through the resistive component 116 after the spark discharge channel is formed.

Figure 4:
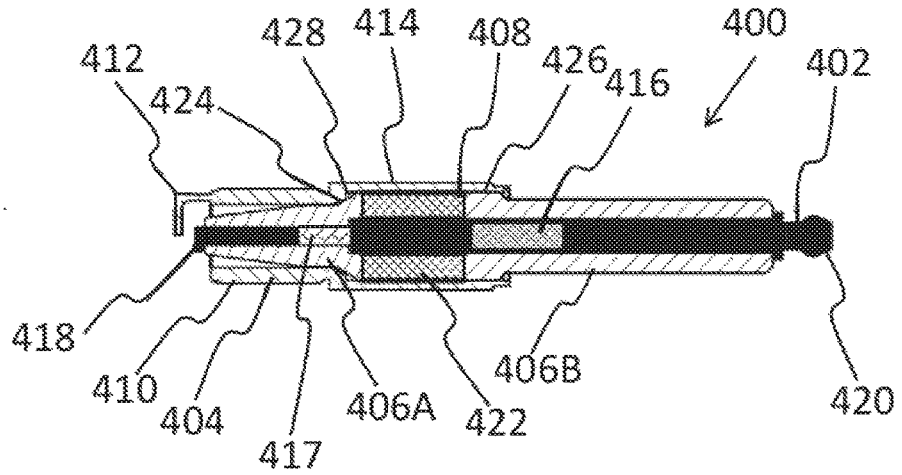
FIG. 4 is a longitudinal cross-sectional view of an implementation of a spark plug.

FIG. 4 is a longitudinal cross-sectional view showing an assembled spark plug according to another embodiment. The spark plug 400 includes a central electrode 402, a metallic shell 404, an insulator body made of aluminum oxide and including a spark-end insulator portion 406A and a terminal-end insulator portion 406B, and capacitor components shown generally at 408. One end 410 of the metallic shell 404 has standard mounting thread (not shown) and is welded with the ground electrode 412. The other end 414 of the metallic shell 404 has a hexagon shape (not shown) to facilitate the application of a mounting torque.

The central electrode 402 is embedded in the insulator body 406, and is fixed using high-temperature adhesive. A first resistive component 416 is built into the central electrode 402 to suppress high frequency noise during the discharging process. A second resistive component 417 is embedded between the capacitor components 408 and the spark-end of central electrode 402, to reduce the peak spark current and thereby provide a longer electrode life. The central electrode 402 is divided into four parts: spark-end 418, terminal end 420, first resistive component 416 and second resistive component 417. The tip of the central electrode 402 at the spark-end 418 can be welded with precious metal, for example, iridium, chromium, etc., to increase the service life of the electrode 402.

In the instant embodiment, the insulator 406 is divided into three parts: the two end portions 406A and 406B are ceramic parts made of aluminum oxide; the middle portion is part of the capacitor components 408, namely the ceramic material 422 with high dielectric constant. Together, the end portions 406A, 406B and the capacitor ceramic material 422 form a "sandwich" style insulator, which is referred to collectively herein as insulator body 406.

Figures 5A, 5B, 5C, 5D:
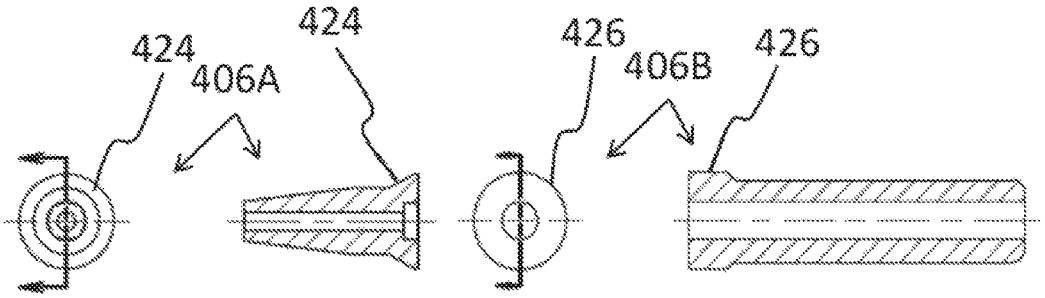
FIG. 5A is an end view of a spark-end insulator portion of the spark plug shown in FIG. 4.
FIG. 5B is a longitudinal cross-sectional view of a spark-end insulator portion of the spark plug shown in FIG. 4.
FIG. 5C is an end view of a terminal-end insulator portion of the spark plug shown in FIG. 4.
FIG. 5D is a longitudinal cross-sectional view of the terminal-end insulator portion of the spark plug shown in FIG. 5C.

Referring also to FIGS. 5A and 5B a sealing surface 424 and a positioning shoulder 426 are provided on the spark-end 406A and terminal-end 406B of the insulator body 406, respectively, to provide gas sealing of the spark plug 400.

Figures 6A, 6B:
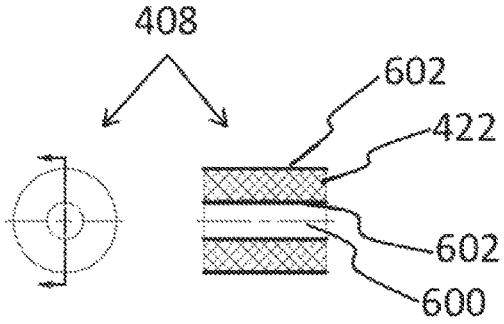
FIG. 6A is an end view of the annular capacitor of the spark plug shown in FIG. 4.
FIG. 6B is a longitudinal cross-sectional view of the annular capacitor of the spark plug shown in FIG. 4.

Referring also to FIGS. 6A and 6B the ceramic material 422 with high dielectric constant, which is sandwiched between the spark-end 406A and terminal-end 406B, forms an annular capacitor 408 with a through-passage 600 for receiving the central electrode 402. Some specific and non-limiting examples of suitable sintered ceramic materials include: strontium titanate, barium strontium titanate, barium titanate, copper calcium titanate, etc. A silver oxide coating forms a silver film 602 during the sintering process under temperature of 800 C-900 C, and both inner and outer surface of the capacitor are metalized and work as conducting surfaces of the capacitor. The end portions 406A, 406B and the capacitor ceramic material 422 are joined using a high temperature insulating adhesive, which reduces or eliminates the possibility of electric discharge through the mating surfaces to the ground electrode.

The insulator body 406 and metallic shell 404 are fastened together, and the gap between sealing surface 424 and metal shell 404 is filled with insulating material 428. The metallic shell 404 provides enhanced mechanical strength, compensating for the relatively low mechanical strength of the high dielectric constant ceramic material 422.

Figure 7:
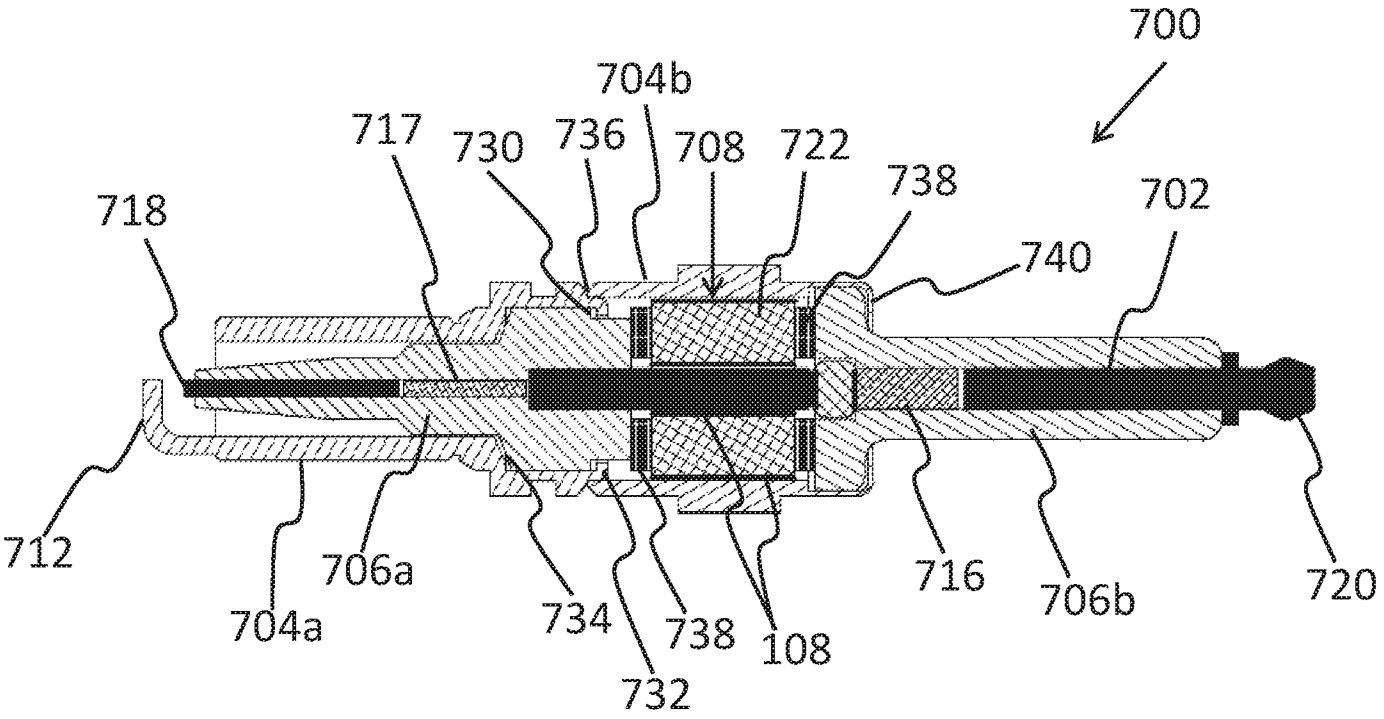
FIG. 7 is a longitudinal cross-sectional view of an implementation of a spark plug.

FIG. 7 is a longitudinal cross-sectional view showing an assembled spark plug according to yet another embodiment. The spark plug 700 includes a central electrode 702, a metallic shell including a first shell-part 704*a* and a second shell-part 704*b*, an insulator body 706 made of aluminum oxide, and capacitor components shown generally at 708. The first metallic shell-part 704*a* has standard external mounting thread (not shown) and is welded with the ground electrode 712. The second metallic shell-part 704*b* has a hexagon shape (not shown) to facilitate the application of a mounting torque.

The central electrode 702 is embedded in the insulator body 706, and is fixed using high-temperature adhesive. The central electrode extends between a spark end 718 and a terminal end 720, and includes a first resistive component 716 to suppress high frequency noise during the discharging process. A second resistive component 717 is embedded between the capacitor components 708 and the spark-end 718 of central electrode 702, in order to reduce the peak spark current and thereby provide a longer electrode life. The tip of the central electrode 702 at the spark-end 718 can be welded with precious metal, for example, iridium, chromium, etc., to further increase the service life of the electrode 702.

In the instant embodiment, the insulator 706 is divided into three parts. The two end portions 706*a* and 706*b* are ceramic parts made of aluminum oxide and the middle portion is part of the capacitor components 708, namely the ceramic material 722 with high dielectric constant. Together, the end portions 706*a*, 706*b* and the capacitor ceramic material 722 form a "sandwich" style insulator, which is referred to collectively herein as insulator body 706.

A method for manufacturing the spark plug 700 will now be described. End portion 706*a* of the insulator body 706 is assembled within the first shell-part 704*a*, which carries an external thread for mounting the spark plug 700. End portion 706*a* of the insulator body 706 has a shoulder 730, and is secured to the first shell-part 704*a* when an end 732 of the first shell-part 704*a* is crimped onto the shoulder 730. A copper gasket 734 provides a gas-tight seal between the components. The central electrode 702 is bonded in the insulator 706*a*. The capacitor components 708 are assembled within the second shell-part 704*b*, which carries a hex-head shaped outer surface for use in applying a mounting torque. The first shell-part 704*a* and the second shell-part 704*b* are welded together via weld joint 736. Electrical insulation gaskets 738 are disposed one each at respective opposite ends of the capacitor components 708. End portion 706*b* of the insulator body 706 is assembled within the second shell-part 704*b*. An end 740 of the second shell-part 704*b* is crimped to fasten the assembly of the capacitor 708, gaskets 738 and insulator 706, thereby forming the spark plug 700.

Figure 8:
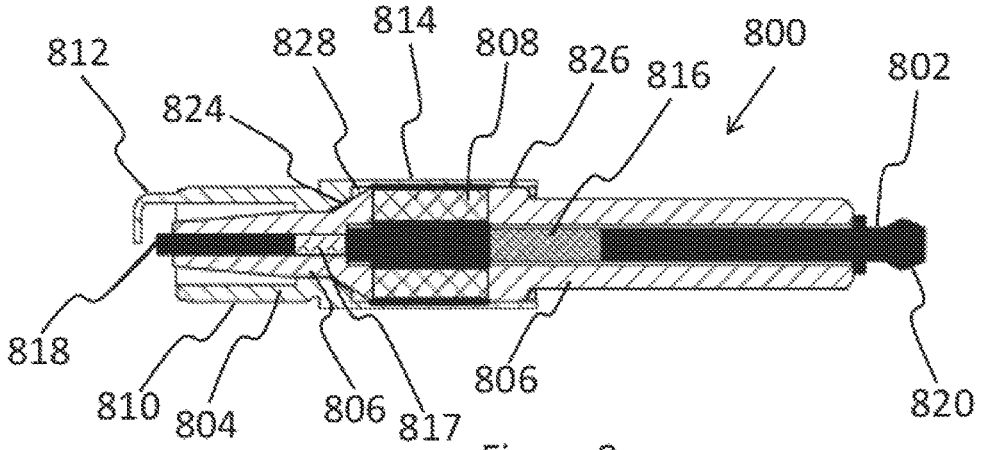
FIG. 8 is a longitudinal cross-sectional view of an implementation of a spark plug.
Figure 9A:
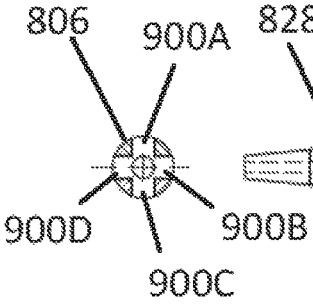
FIG. 9A is a cross-sectional end view of the insulator of the spark plug shown in FIG. 8, taken along the line A-A in FIG. 9B.
Figure 9B:
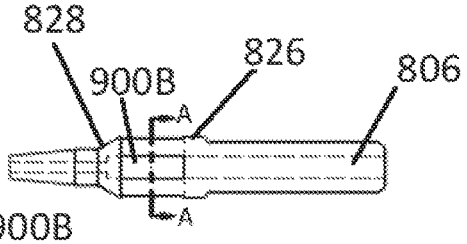
FIG. 9B is a longitudinal cross-sectional view of the insulator of the spark plug shown in FIG. 8.
Figure 9C:
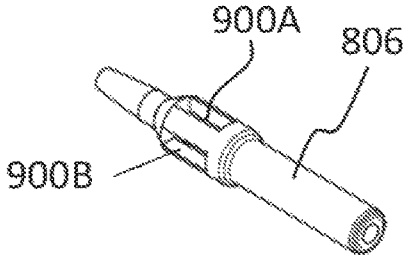
FIG. 9C is a terminal-end perspective view of the insulator of the spark plug shown in FIG. 8.
Figures 10A, 10B:
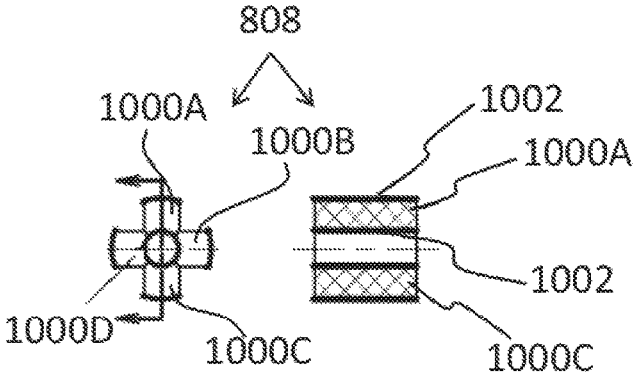
FIG. 10A is an end view of the annular capacitor of the spark plug shown in FIG. 8.
FIG. 10B is a longitudinal cross-sectional view of the annular capacitor of the spark plug shown in FIG. 8.

FIG. 8 is a longitudinal cross-sectional view showing an assembled spark plug according to another embodiment. The spark plug 800 includes a central electrode 802, a metallic shell 804, an insulator body 806 made of aluminum oxide, and capacitor components shown generally at 808. One end 810 of the metallic shell 804 has standard mounting thread (not shown) and is welded with the ground electrode 812. The other end 814 of the metallic shell 804 has a hexagon shape (not shown) to facilitate the application of a mounting torque.

The central electrode 802 is embedded in the insulator body 806, and is fixed with high-temperature adhesive. Resistive component 816 is built into the central electrode 802 to suppress high frequency noise during the discharging process. A resistive component 817 embedded between the capacitor components 808 and the spark-end of central electrode 802, to reduce the peak spark current and thereby provide a longer electrode life. The central electrode 802 is divided into four parts: spark-end 818, terminal end 820, resistive component 816 and resistive component 817. The tip of the central electrode 802 at the spark-end 818 can be welded with precious metal, for example, iridium, chromium, etc., to increase the service life of the electrode 802.

Referring also to FIGS. 9A-9C and FIGS. 10A-10B, capacitor channels 900A-900D are formed in the aluminum oxide insulator body 806, and capacitor 808 is installed in these channels. Optionally, the ceramic pieces 1000A-1000D of capacitor 808 are sintered separately and then assembled and bonded with the aluminum oxide insulator body 806. Alternatively, the ceramic pieces 1000A-1000D are assembled and then sintered together. Some specific and non-limiting examples of suitable sintered ceramic materials include: strontium titanate, barium strontium titanate, barium titanate, copper calcium titanate, etc. A metalizing treatment can be performed afterward on both the capacitor ceramic surface and the aluminum oxide surface to form conductor surfaces, e.g. conductive surfaces 1002 in FIG. 10. For instance, a silver oxide coating forms a silver film during the sintering process under temperature of 800 C-900 C, and both inner and outer surface of the capacitor are metalized and work as conducting surfaces of the capacitor.

Of course, a sealing surface 824 and a positioning shoulder 826 are provided on the insulator body 806 to provide gas sealing of the spark plug 800. The insulator body 806 and metallic shell 804 are fastened together, and the gap between sealing surface 824 and metal shell 804 is filled with insulating material 828. The metallic shell 804 provides enhanced mechanical strength, compensating for any reduced mechanical strength resulting from forming the capacitor channels 900A-900D.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the principles disclosed herein is/are used. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Numerical ranges include the end-point values that define the ranges. For instance, "between X and Y" includes both X and Y, as well as all temperature values between X and Y.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In places where the description above refers to particular implementations of high-power breakdown spark plugs and related methods and implementing components, sub-components, methods and sub-methods, it should be readily apparent that a number of modifications may be made without departing from the spirit thereof and that these implementations, implementing components, sub-components, methods and sub-methods may be applied to other high-power breakdown spark plugs and related methods.

What is claimed is:

1. A spark plug comprising:

an insulator body having an opening extending therethrough and comprising first dielectric material adjacent a first end thereof and third dielectric material adjacent a second end thereof that is opposite the first end;

a central electrode having a spark-end and a terminal-end, the central electrode received within the opening of the insulator body with the spark-end protruding from the first end of the insulator body and the terminal-end protruding from the second end of the insulator body;

a metal electrode surrounding the insulator body and extending to form a gap with the central electrode proximate the spark-end;

a capacitor comprising a second insulating material having a higher dielectric constant than the first and third dielectric materials, the second insulating material being disposed between the first end and the second end of the insulating body, and the second insulating material having a metalized inner surface and a metallized outer surface so as to form the capacitor, wherein the metalized inner surface of the capacitor is connected to the central electrode and the metalized outer surface of the capacitor is connected to the metal electrode;

a first resistive component embedded within the central electrode between the capacitor and the terminal-end for suppressing electromagnetic interference; and a second resistive component embedded within the central electrode between the capacitor and the spark-end.

2. The spark plug according to claim 1, wherein the capacitor is an annular capacitor having a central through passage that is bounded by the metallized inner surface, wherein the first dielectric material and the third dielectric material are a same dielectric material, wherein the same dielectric material forms an intermediate portion between the first end and the second end of the insulator body and the opening extends through the intermediate portion, and wherein the intermediate portion is received within the central through passage of the annular capacitor, and further comprising:

a conductive element extending between the metalized inner surface of the capacitor and the central electrode via a channel defined through the intermediate portion for connecting the metallized inner surface of the capacitor to the central electrode.

3. The spark plug according to claim 2, wherein the first end, the second end and the intermediate portion of the insulator body are parts of a unitary structure comprising a sealing surface and a positioning shoulder for engaging the metal electrode and forming a gas-tight seal.

4. The spark plug according to claim 1, wherein the insulator body comprises a spark-end portion having a sealing surface and a separate terminal-end portion having a positioning shoulder, the sealing surface and positioning shoulder for engaging the metal electrode and forming a gas-tight seal.

5. The spark plug according to claim 4, wherein the capacitor is sandwiched between the spark-end portion and the terminal-end portion of the insulator body.

6. The spark plug according to claim 5, wherein the capacitor is an annular capacitor having a central through passage that is aligned with the opening extending through the insulator body, and wherein the central electrode is received within the central through passage.

7. The spark plug according to claim 1, wherein the insulator body comprises a plurality of circumferentially spaced capacitor channels formed between the first end and the second end, and wherein the capacitor comprises a plurality of capacitor elements disposed one each within the plurality of capacitor channels.

8. The spark plug according to claim 7, wherein the insulator body is a unitary structure comprising a sealing surface and a positioning shoulder for engaging the metal electrode and forming a gas-tight seal.

9. The spark plug according to claim 1, wherein:

the insulator body comprises a spark-end portion at the first end and a separate terminal-end portion at the second end;

the metal electrode comprises a spark-end portion and a separate terminal end portion; and wherein;

the capacitor is disposed between the spark-end portion and the terminal end portion of the insulator body;

a first end of the spark-end portion of the metal electrode extends to form the gap and a second end of the spark-end portion of the metal electrode is crimped to engage a shoulder of the spark-end portion of the insulator body for securing the spark-end portion of the insulator body within the spark-end portion of the metal electrode; and a first end of the terminal-end portion of the metal electrode is fixedly secured to the second end of the spark-end portion of the metal electrode by a weld seam, and a second end of the terminal end portion of the metal electrode is crimped to engage a shoulder of the terminal-end portion of the insulator body for securing the terminal-end portion of the insulator body within the terminal end portion of the metal electrode.

10. The spark plug according to claim 9, comprising a first insulating gasket disposed between the spark-end portion of the insulator body and a first end of the capacitor, and a second insulating gasket disposed between the terminal end portion of the insulating body and a second end of the capacitor.

11. A spark plug component comprising:

an insulator having a central opening extending therethrough for receiving a central electrode, the insulator forming an annular ring about the central opening, the insulator comprising:

first dielectric material forming a first end of the insulator and defining a first portion of the annular ring about the central opening, third dielectric material forming a second end of the insulator that is opposite the first end and defining a second portion of the annular ring about the central opening, and a space between the first and third dielectric materials for accommodating a second insulating material having a higher dielectric constant than the first and third dielectric materials, wherein the second insulating material is a part of a capacitor element and comprises metallized inner and outer surfaces, wherein the first dielectric material, the second dielectric material and the spacers cooperate to form the space as a slot-shaped gap in the annular ring between the first dielectric material and the third dielectric material, and wherein the capacitor element is disposed within the slot-shaped gap and is orientated such that the inner metallized surface faces toward the central opening.

12. The spark plug component according to claim 11, wherein the first dielectric material and the third dielectric material are a same dielectric material and wherein the spacers are formed of the same dielectric material.

13. The spark plug component according to claim 11, wherein the first dielectric material, the second dielectric material and the spacers cooperate to form a plurality of slot-shaped gaps in the annular ring between the first dielectric material and the third dielectric material, the slot-shaped gaps being circumferentially arranged around the central opening and wherein one capacitor element is disposed within each slot-shaped gap of the plurality of slot-shaped gaps.

* * * * *